United States Patent [19]

Kim

[11] Patent Number: 4,846,378

[45] Date of Patent: Jul. 11, 1989

[54] SELF-SEALING NOZZLE

[76] Inventor: Charles C. Kim, 11916 Victoria Ave., Los Angeles, Calif. 90066

[21] Appl. No.: 186,912

[22] Filed: Apr. 27, 1988

[51] Int. Cl.[4] ..... B67D 3/00

[52] U.S. Cl. ..... 222/479; 137/38; 222/491

[58] Field of Search ..... 222/162, 166, 188, 454–456, 222/464, 479, 482, 491, 500, 563; 215/266; 137/38

[56] References Cited

U.S. PATENT DOCUMENTS

| | | | |
|---|---|---|---|
| 927,195 | 7/1909 | Walton | 222/500 |
| 2,362,150 | 11/1944 | Odin | 215/266 |
| 2,584,130 | 2/1952 | Huebl et al. | 222/455 |
| 2,991,897 | 7/1961 | Burnett | 222/500 X |
| 3,223,295 | 12/1965 | Falerni et al. | 222/456 X |

FOREIGN PATENT DOCUMENTS

| | | | |
|---|---|---|---|
| 81736 | 9/1963 | France | 222/500 |

*Primary Examiner*—Michael S. Huppert
*Attorney, Agent, or Firm*—Keith D. Beecher

[57] ABSTRACT

A pouring nozzle for a soft drink, milk or liquor bottle, carton, or the like, which has a feature in that when the container is in an upright position, the nozzle automatically closes to seal off the container. The nozzle includes an internal ball which floats on liquid trapped in the nozzle to close and seal the nozzle when the container is upright. However, the ball is forced into a cavity in the nozzle when the container is tilted over to permit liquid to flow freely from the container through the nozzle.

6 Claims, 2 Drawing Sheets

SELF-SEALING NOZZLE

BACKGROUND OF THE INVENTION

The invention is concerned with pouring nozzles which may be screwed onto, or otherwise attached, to the necks of bottles or other vessels containing liquids, such as liquor, milk, soft drinks, and the like.

The nozzle of the invention is constructed to be self-sealing whenever the container is in an upright position, and yet to permit free flow of liquid from the container, whenever the container is tilted.

DETAILED DESCRIPTION OF THE ILLUSTRATED EMBODIMENTS

Figure 2:
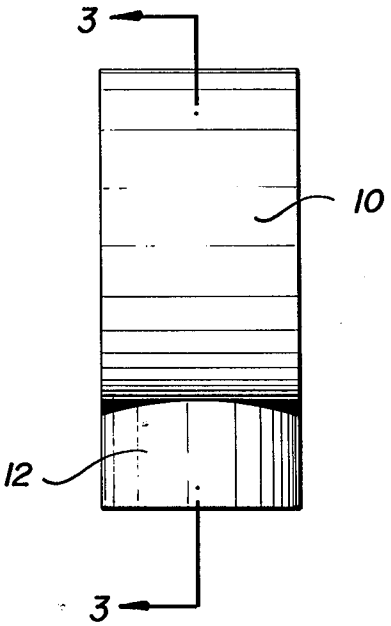
FIG. 2 is a rear view of the nozzle of FIG. 1.
Figure 1:
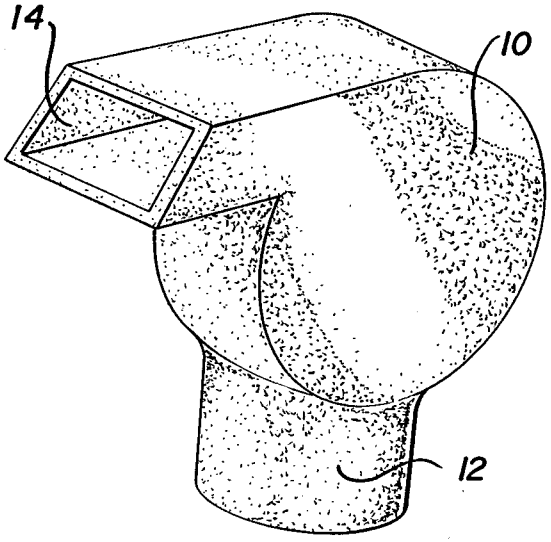
FIG. 1 is a perspective view of a self-sealing pouring nozzle constituting one embodiment of the invention.
Figure 3:
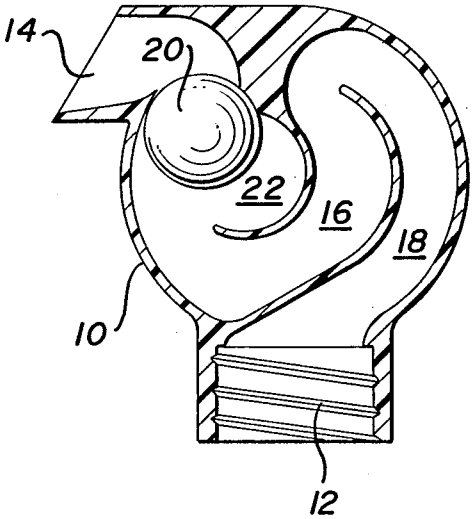
FIG. 3 is a section of the nozzle of FIG. 2, taken along the line 3—3 of FIG. 2.

The nozzle of the invention in the embodiment shown in FIGS. 1, 2 and 3, may be formed of an appropriate plastic material, and forms a housing 10 having an inlet neck portion 12 and an outlet spout portion 14. As shown in FIG. 2, the neck portion is adapted to be screwed onto a bottle containing, for example, liquor, or other liquid. The housing 10 forms an internal chamber 16 adjacent to the spout 14, and it also forms a passage 18 extending from the neck 12 around the housing and into chamber 16. A floatation member 20 in the form of a ball is contained in chamber 16.

In the position shown in FIG. 3, liquid from a previous pouring is trapped in chamber 16, and the liquid serves to force the ball 20 against the entrance to spout 14, sealing the spout. However, when the container is tilted, the liquid in chamber 16 forces the ball back away from the entrance to the spout and into a cavity 22, permitting the liquid freely to flow from the bottle through the nozzle and out of the spout.

Figure 4:
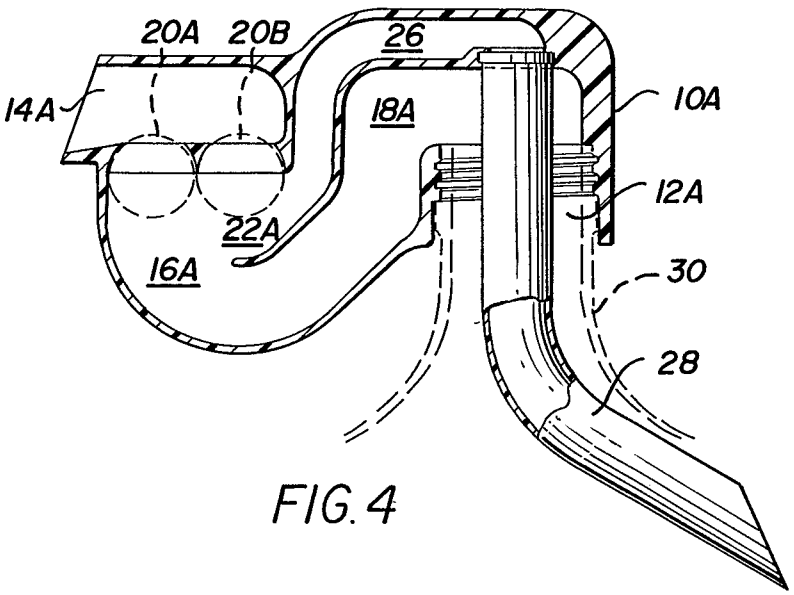
FIG. 4 is a sectional view of a nozzle, representing a second embodiment of the invention.

The embodiment of FIG. 4 shows a modified type of nozzle defining a housing 10A with a spout 14A and a neck 12A. The housing 10A defines a passage 18A from the neck 12A to an internal chamber 16A. The housing 10A also defines a cavity 22A which extends as a passage 26. A conduit 28 is coupled to passage 26, and conduit 28 extends down through the neck 12A of the nozzle and into a bottle 30, the nozzle being screwed to the neck of the bottle. Conduit 28 forms a vent into the interior of the bottle 30 when the bottle is first tilted to open the nozzle, assuring free flow of the liquid out of the bottle and into the nozzle.

The dispenser of FIG. 4 includes a pair of floatation balls 20A, 20B, each serving to close and seal a separate entrance to spout 14A.

The operation of the nozzle of FIG. 4 is similar to that of FIGS. 1, 2 and 3 described above.

The invention provides, therefore, a simple and inexpensive nozzle for a bottle, or other container, which provides for free flow of liquid from the container when tilted, and which acts as a seal for the container when in an upright position.

It will be appreciated that while particular embodiments of the invention have been shown and described, modifications may be made. It is intended in the claims to cover all modifications which come within the true spirit and scope of the invention.

I claim:

1. A pouring nozzle for attachment to a container which includes a housing having an inlet neck portion for attachment to the container and further having an outlet spout portion, said housing defining a chamber adjacent to said spout portion and a passage extending from said inlet neck portion to said chamber; and a floatation member contained in said chamber and movable into sealing relationship with said spout portion by liquid trapped in said chamber when the pouring nozzle is in an upright position, and movable away from said spout portion to permit liquid to flow through said spout portion when the nozzle is tilted.

2. The pouring nozzle defined in claim 1, in which said housing forms a cavity in said chamber for receiving the flotation member when the nozzle is tilted.

3. The pouring nozzle defined in claim 1, in which the floatation member is in the form of a ball.

4. The pouring nozzle defined in claim 2, in which said cavity extends as a passage through said nozzle, and which includes conduit means coupled to said passage and extending through said inlet neck portion into said container to provide a vent for said container.

5. The pouring nozzle defined in claim 4, in which said spout has two openings, and which includes two floatation members for the respective openings.

6. The pouring nozzle defined in claim 5, in which the floatation members are in the form of balls.

* * * * *